United States Patent [19]

Le

[11] Patent Number: 5,065,463

[45] Date of Patent: Nov. 19, 1991

[54] STRUCTURE OF SHOWER WITH SWIVEL BRUSH AND MULTI-STEP DRAIN CONTROL

[76] Inventor: Mike Le, 7/F., No. 20 Lane 50, Yan Chi St., Taipei, Taiwan

[21] Appl. No.: 500,567

[22] Filed: Mar. 28, 1990

[51] Int. Cl.[5] ..... A46B 13/06

[52] U.S. Cl. ..... 4/606; 4/567; 4/601; 15/29; 128/56

[58] Field of Search ..... 4/567-570, 4/601, 605, 606, 628; 15/24, 28, 29; 137/861, 862, 869, 872, 874, 876, 887, 603; 128/47, 50, 53, 56

[56] References Cited

U.S. PATENT DOCUMENTS

| | | | |
|---|---|---|---|
| 1,525,237 | 2/1925 | Hilfiker | 4/567 |
| 2,051,278 | 8/1936 | Svenson | 137/862 |
| 2,094,161 | 9/1937 | Paddock | 137/603 |
| 3,182,336 | 5/1965 | Greuter | 4/570 |
| 4,089,079 | 5/1978 | Nicholson | 15/29 |
| 4,228,558 | 10/1980 | Zhadanov | 15/29 |
| 4,282,623 | 8/1981 | Gacuzana | 15/29 X |
| 4,712,265 | 12/1987 | Williams | 4/606 X |
| 4,841,590 | 6/1989 | Terry et al. | 15/28 |

FOREIGN PATENT DOCUMENTS

| | | | |
|---|---|---|---|
| 0280833 | 9/1988 | European Pat. Off. | 15/29 |
| 2405791 | 11/1974 | Fed. Rep. of Germany | 15/29 |
| 2433575 | 1/1976 | Fed. Rep. of Germany | 15/29 |
| 2854608 | 6/1980 | Fed. Rep. of Germany | 15/29 |
| 3113645 | 10/1982 | Fed. Rep. of Germany | 15/29 |

*Primary Examiner*—Henry J. Recla
*Assistant Examiner*—Casey Jacyna

[57] ABSTRACT

A shower, which is incorporated with an adapter through a water pipe and an inner water tube for fastening in a water faucet to guide water to discharge from a perforated nozzle on the shower head thereof to produce fine streams of water for shower bath. A plurality of water channels are made inside the shower head and controlled by a drain cock in the handle portion of the shower head permitting flow of water to drive a swivel brush to rotate for body friction and simultaneously to discharge from the perforated nozzle so as produce fine streams of water for shower bath.

5 Claims, 4 Drawing Sheets

STRUCTURE OF SHOWER WITH SWIVEL BRUSH AND MULTI-STEP DRAIN CONTROL

BACKGROUND OF THE INVENTION

The present invention is related to showers and more particularly to a shower which comprises a drain cock having two passage ways therethrough to control flow of water alternatively through a variety of water channels so as to produce fine streams of water or to drive a bath brush to rotate for body friction, or to let water discharge directly without passing through the shower head thereof.

A shower is an apparatus in a bath-room used for spraying fine streams of water for washing the body. Regular showers generally comprise a perforated nozzle for discharging therefrom of water to produce fine streams of water for shower bath, which do not have any structure for drain control and do not provide any additional function.

SUMMARY OF THE INVENTION

It is therefore an object of the present invention to provide a shower which produces fine streams of water for shower bath.

Another object of the present invention is to provide a shower which provides a water loop for direct discharge of water in a bath-tub without passing through the shower head thereof so that water is directly collected in a bath-tub for dipping.

Still another object of the present invention is to provide a shower which comprises a bath brush incorporated with the shower head thereof and driven to rotate by water flow for body friction.

To accomplish the above objects, there is provided a shower which is incorporated with an adapter through a water pipe for fastening in a water faucet. An inner water tube is set inside the water pipe and connected between the adapter and the shower head thereof. A first water channel is defined in the inner water tube for feeding of water. A fourth water channel is defined between the inner water tube and the water pipe for reverse flow of water from the shower head. A second, a third, a fifth and a sixth water channels are respectively made inside the shower head. A drain cock which comprises a first passage way and a second passage way is disposed in the first water channel to control water from the first water channel to flow through the fifth water channel, the fourth water channel via the second water channel, or the third water channel via the second water channel. When the drain cock is turned 90° rightward to a first drain position, the first water channel is communicated with the fifth water channel permitting water from a water faucet to strike a water wheel to drive a bath brush, which is attached to a perforated nozzle on the shower head, to rotate for body friction, and permitting reverse flow of water to flow from the sixth water channel through the fourth water channel for further discharge from a water outlet on the adapter. When the drain cock is turned to a second drain position, flow of water is permitted to push the bath brush to rotate for body friction and to further discharge from the perforated nozzle of the shower head to produce fine streams of water for shower bath. When the drain cock is turned to a third drain position, flow of water runs through the second water channel, the second passage way and the third water channel for discharge from the perforated nozzle of the shower head for shower bath. When the drain cock is turned to a fourth drain position, flow of water from a water faucet flows through the second water channel into the fourth water channel for discharge through the water outlet of the adapter without passing through the shower head, so that water can be completely collected in a bath-tub for dipping.

BRIEF DESCRIPTION OF THE DRAWINGS

The present invention will now be described by way of example with reference to the annexed drawings, in which.

10—shower head
11—first water channel
12—second water channel
13—third water channel
14—fourth water channel
15—fifth water channel
16—sixth water channel
17—plurality of branches
18—outlet of branches
21—control knob
22—drain cock
23—first passage way
24—second passage way
31—water wheel
32—pinion
33—bull wheel
34—water outlet
41—bath brush
50—adapter
51—connector
52—water chamber
53—water pipe
54—water outlet
55—inner water tube
60—water flow rate controlling device

DETAILED DESCRIPTION OF THE PREFERRED EMBODIMENTS

Figure 1:
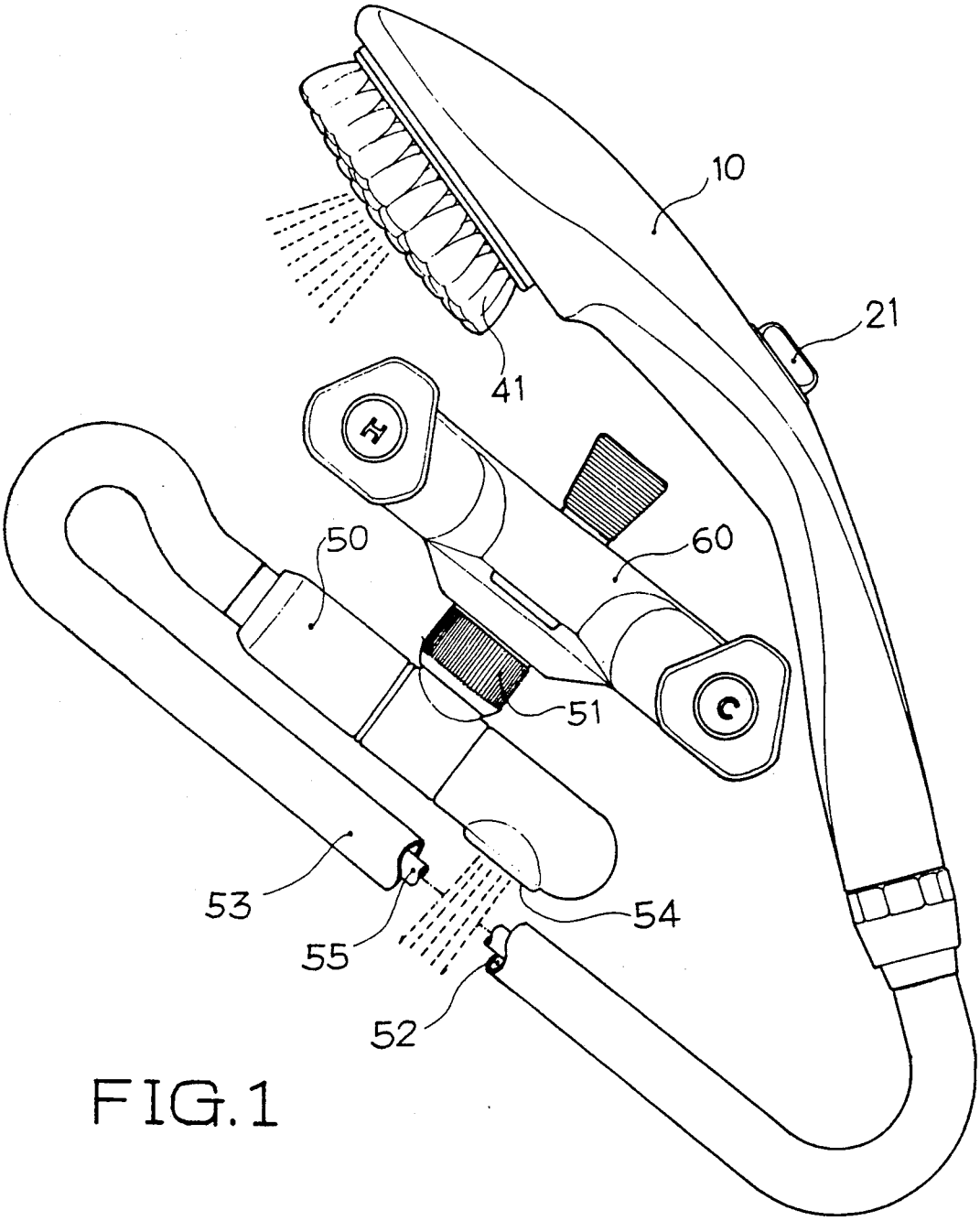
FIG. 1 illustrates a shower embodying the present invention.
Figure 2:
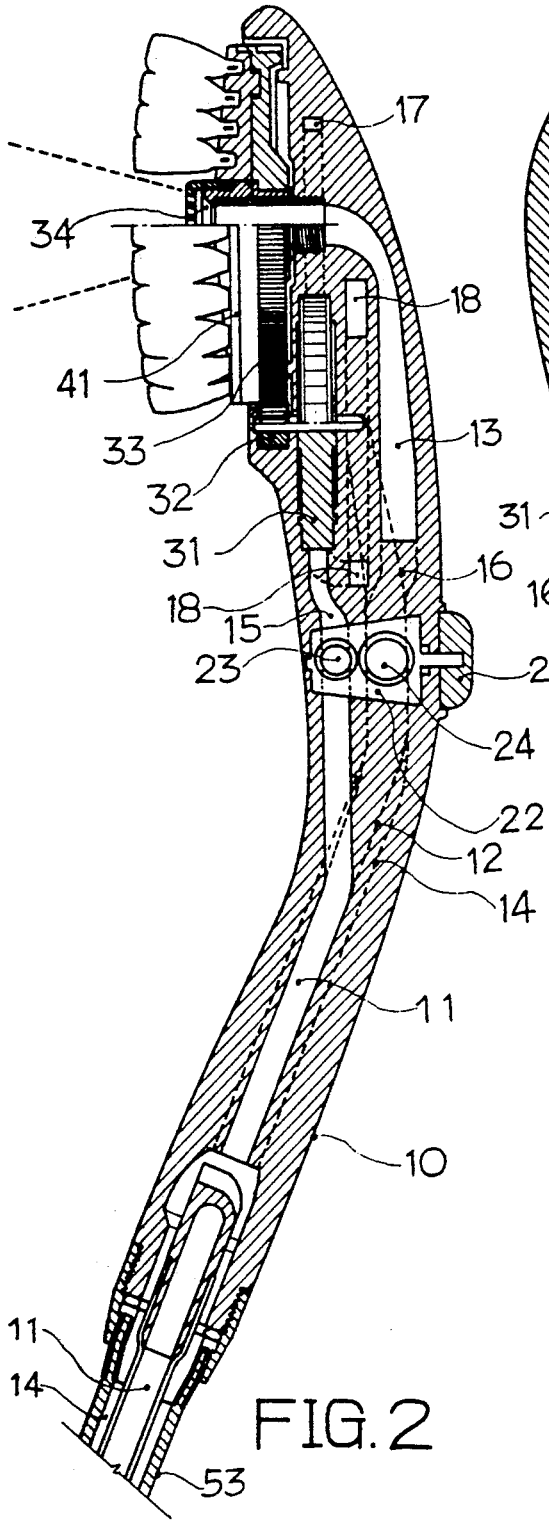
FIGS. 2 and 2*a* are two sectional views illustrating the internal structure of the shower head thereof.
Figure 2A:
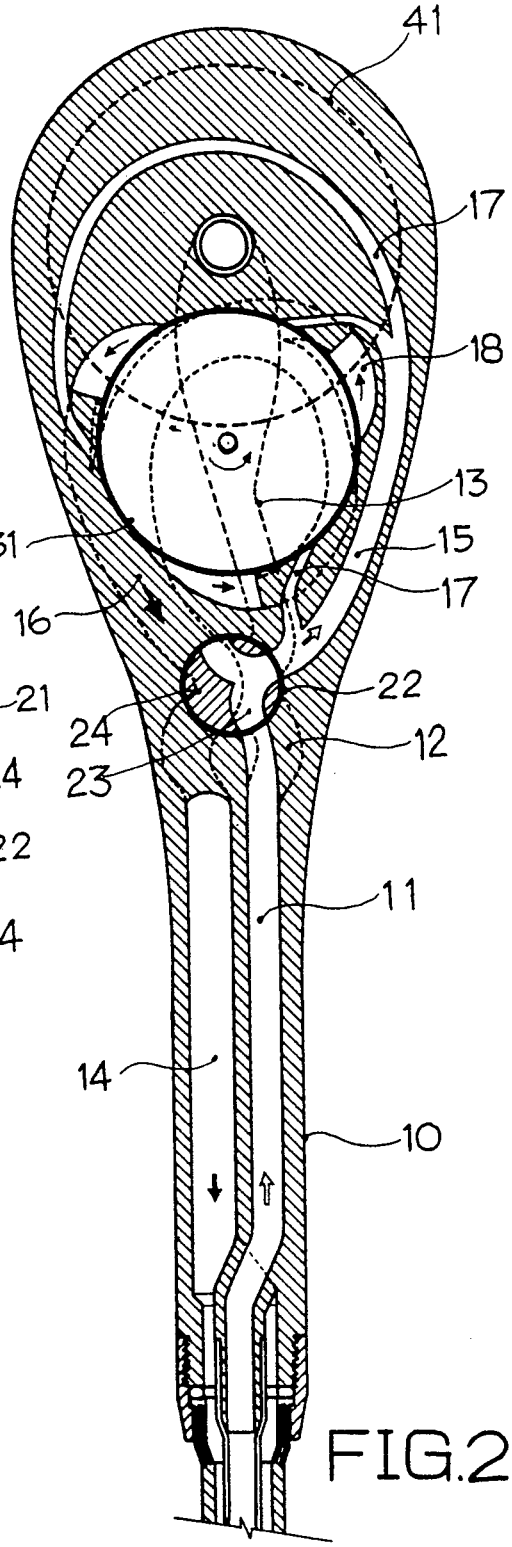
Figure 3C:
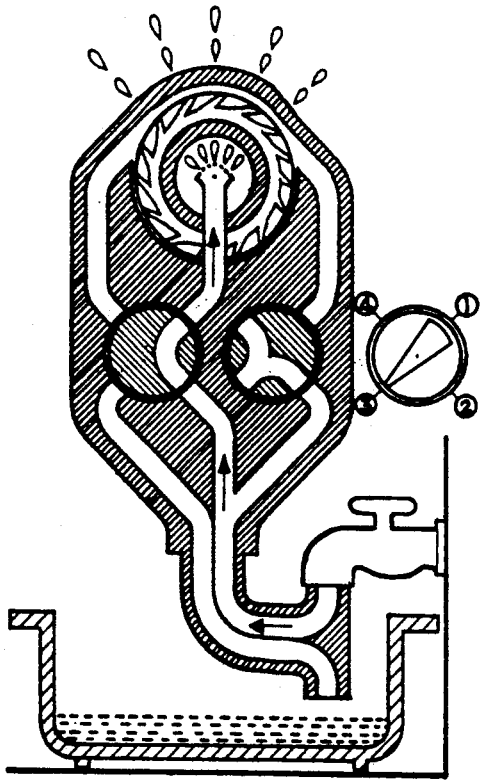
FIGS. 3*a*-3*d* are schematic drawings, illustrating four different arrangements of drain control through the drain cock thereof.
Figure 3A:
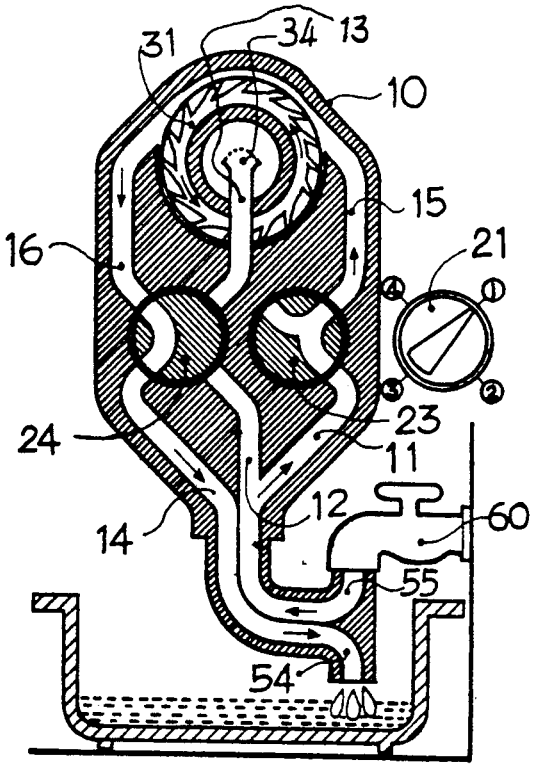
Figure 3D:
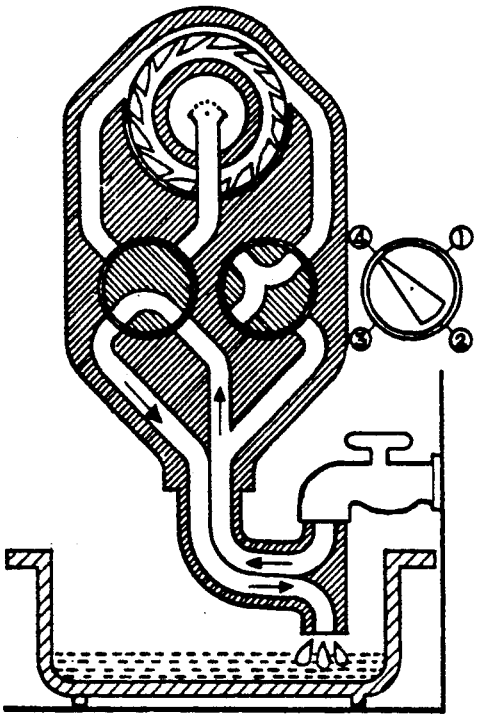
Figure 3B:
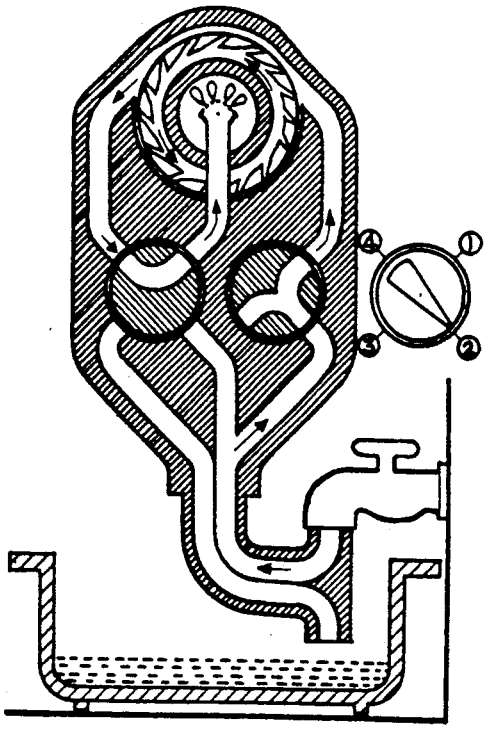
Figure 5:
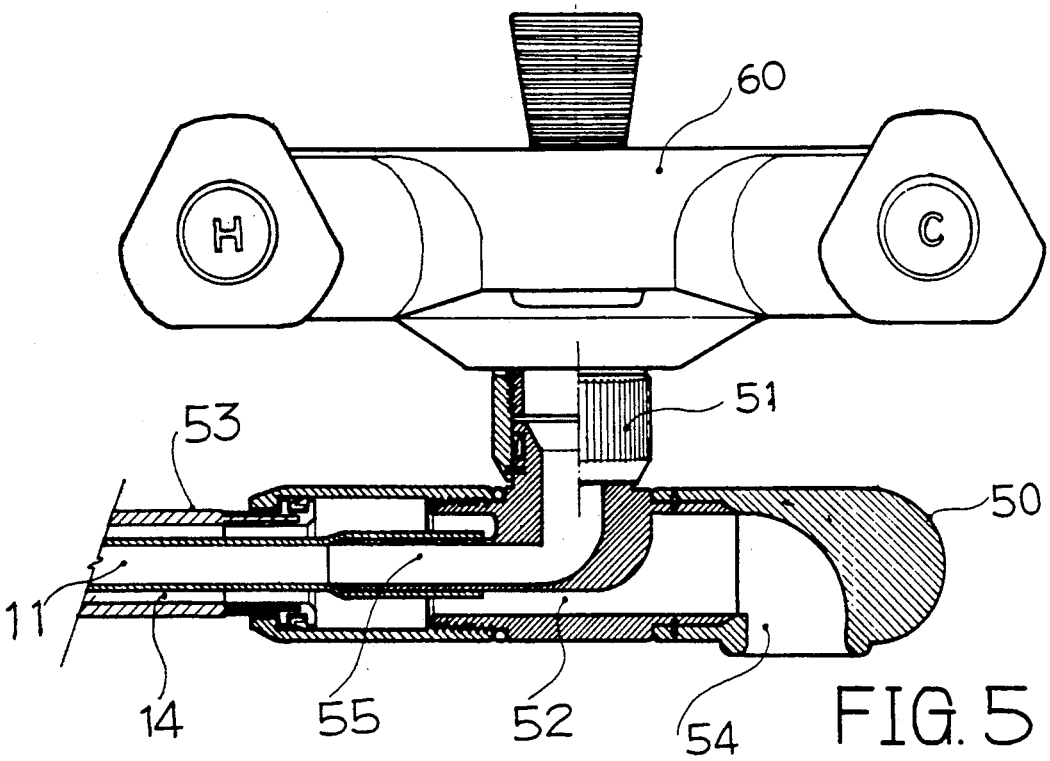
FIG. 5 is a sectional view of the adapter of the present invention.
Figure 4:
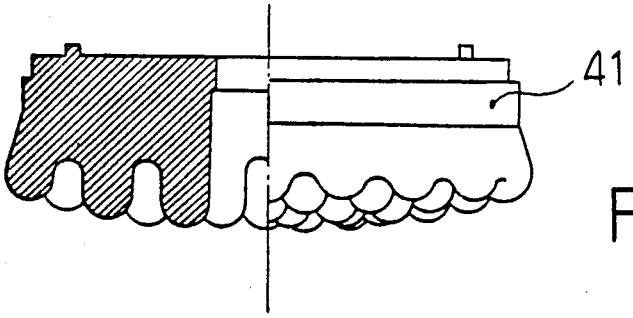
FIGS. 4 and 4*a* illustrate two embodiments of bath brush according to the present invention.
Figure 4A:
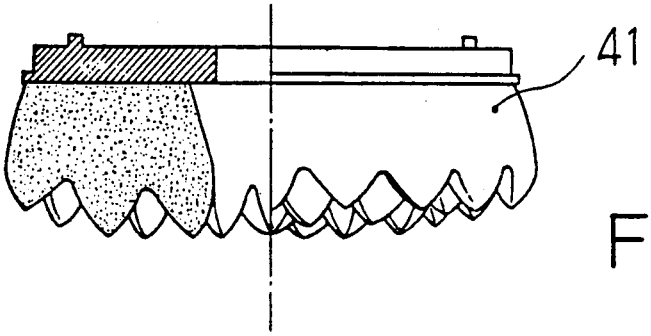

Turning now to the annexed drawings in greater detail and referring first to FIG. 1, therein illustrated is a shower in accordance with the present invention and generally comprised of a shower head 10 and an adapter 50. The adapter 50 is incorporated with a connector 51 for connection to a water faucet or other water flow rate controlling device 60 through pivot joint, which defines therein a hollow water chamber 52 having a water outlet 54 on the housing thereof for discharging of water from the water chamber 52, and a water pipe 53 at an opposite end and connected to the shower head 10. An inner water tube 55 is set in the water pipe 53 to connect the shower head 10 to the connector 51 through the water chamber 52 so that the water which comes from a water faucet can pass through the inner water tube 55 into a first water channel 11 inside the shower head 10, and reverse flow of water from the shower head 10 can flow back through a fourth water channel 14 inside the shower head 10 and a water chamber, which is defined between the water pipe 53 and the inner water tube 55, to discharge from the water outlet 54.

Referring to FIGS. 2, 2*a* and 3*a–d*, the first and fourth water channels 11, 14 are disposed in the handle portion of the shower head 10 and respectively communicating with the water pipe 53, wherein a second water channel 12 deviates from the first water channel 11. A drain cock 22 which comprises a first passageway 23 and a second passageway 24 is set in the middle of the handle portion of the shower head 10 to control the communication of the first, second and fourth water channels 11, 12, 14, with a third water channel 13, a fifth water channel 15 and a sixth water channel 16 alternatively, which third, fifth and sixth water channels 13, 15, 16 are respectively set inside the shower head 10 at an upper position.

A bath brush 41 is releasably secured to the shower head 10 and driven to rotate by a bull gear 33 and a pinion 32 which are coupled with a water wheel 31 inside the shower head 10. In the center of the bath brush 41, there is a water outlet 34 for the third water channel 13 and coupled with a perforated nozzle so that fine streams of water can be sprayed therefrom. When water flows into the fifth water channel 15 the water wheel 31 is pushed by water impact force to carry the pinion 32 to rotate, so as to further carry the bath brush 41 to rotate via the bull gear 33. Thus, the bath brush 41 can be simultaneously used as a body friction brush. The fifth water channel 15 communicates with the first passageway 23 of the drain cock 22 to receive water from the first water channel 11, and is divided into a plurality of branches 17 to guide water to strike the periphery of the water wheel 31. After striking on the water wheel 31, water is collected together to flow into the sixth water channel 16 which extends to the second passageway 24 of the drain cock 22 to guide water to flow through the third water channel 13 or the fourth water channel 14. Under normal condition, the first water channel 1 extends to the first passageway 23 of the drain cock 22 and the second and fourth water channels 12, 14 extend to the second passageway 24 of the drain cock 22.

A control knob 21 is mounted on the drain cock 22 to control its positioning in the handle portion of the shower head 22. The first passageway 23 is a three-way hole designed in T-shaped structure to control the communication of the first water channel 11 and the fifth water channel 15. The second passageway 24 is a two-way hole designed in right angle to control the communication of the second, third and fourth water channels 12, 13, 14, with the sixth water channel 16.

By means of the control of the drain cock 22 to change the position of the first passageway 23 and the second passage 24, four kinds of actions will arise:

1) When the drain cock 22 is turned 90° to the right (see FIG. 3*a*), the first passageway 23 is in communication with the first water channel 11 and the fifth water channel 15, the second passageway 24 is in communication with the sixth water channel 16 and the fourth water channel 14, and the second and third water channels 12 are blocked up. This arrangement permits water from the water faucet 60 to flow through the adapter 50 and the first water channel 11 into the fifth water channel 15 to strike the water wheel 31 to carry the bath brush 41 to rotate, and simultaneously permits reverse flow of water to flow back to the adapter 50 for discharge into a bath-tub from the water outlet 54. Under this arrangement, the bath brush 41 can be simultaneously used for soaping and massaging one's body.

2) When the drain cock 22 is turned 180° to the right (see FIG. 3*b*), the first passageway 23 is still in communication with the first water channel 11 and the fifth water channel 15, and the second passageway 24 is turned to communicate the sixth water channel 16 with the third water channel 13. Under this arrangement, water from the water faucet flows through the first and fifth water channels 11, 15 to strike the water wheel 31 to carry the bath brush 41 to rotate and simultaneously flows through the third water channel 13 to discharge from the perforated nozzle on the water outlet 34 of the shower head 10. Thus, fine streams of water are sprayed from the shower head 10 for cleaning body soap, and the bath brush 41 is simultaneously drive to rotate for body friction.

3) When the drain cock 22 is turned 270° to the right (see FIG. 3*c*), the second passageway 23 blocks up the passage of the first water channel 11 and communicates the second water channel 12 with the third water channel 13 permitting water from the first water channel 11 to directly flow into the second water channel 12 to the shower head 10 for discharging from the water outlet 34. Under this arrangement, the shower becomes a simple apparatus for spraying fine streams of water.

4) When the drain cock 22 is turned 360° to the right (see FIG. 3*d*), the first water channel 11 is still blocked up by the first passage way 23 and the second passageway 24 communicates the second water channel 12 with the fourth water channel 14 permitting water from the water faucet 60 to flow back to a bath-tub.

As described above, the shower of the present invention can be conventiently fastened in a water faucet or the like by means of the adapter. Flexible drain control is controlled by means of the position change of the drain cock, such that flow of water can be guided to drive the bath brush to rotate for body friction and simultaneously to discharge through the perforated nozzle of the shower head to further produce fine streams of water for shower bath.

I claim:

1. A shower, comprising:

a shower head having a water outlet and defining within said shower head first, second, third, fourth, fifth and sixth water channels;

a drain cock having first and second passageways and being set in said shower head and connected to said six water channels to control the flow of water in said water channels;

a rotating brush attached to said water outlet;

a water wheel attached to said rotating brush to drive said rotating brush and cause said brush to rotate;

an adapter for connecting said shower head to a water outlet of a source of water;

a double-core water pipe connecting said adapter to said shower head and defining water supply and return channels therein;

characterized in that when said drain cock is at a first drain position, water is permitted to flow from said first water channel through said first passageway of said drain cock into said fifth water channel to drive said water wheel and to cause said brush to rotate and thence through said sixth water channel and said second passageway to discharge through said adapter;

when said drain cock is at a second drain position, water is permitted to flow from said first water channel through said first passageway of said drain cock into said fifth water channel to drive said water wheel and to cause said brush to rotate and thence through said sixth water channel and said second passageway of said valve cock into said third water channel to discharge from said water outlet of said shower head;

when said drain cock is at a third drain position, water is permitted to flow from said second water channel through said second passageway of said drain cock into said third water channel to discharge from said water outlet of said shower head;

and when said drain cock is at a fourth drain position, water is permitted to flow from said second water channel through said second passageway of said drain cock into said fourth water channel for discharge through said adapter.

2. A shower as claimed in claim 1, wherein said water outlet of said shower head is a perforated nozzle and said rotating brush is attached to said perforated nozzle.

3. A shower as claimed in claim 1, wherein said drain cock comprises a control knob formed on a top portion of said cock for controlling a position of said first and second passageway.

4. A shower as claimed in claim 1, wherein said first passageway of said drain cock is a three-way hole, and said second passageway of said drain cock is a two-way hole.

5. A shower as claimed in claim 1, wherein said adapter has a hollow body defining therein a water chamber having one end of said adapter connected to said shower head through said water pipe and having a water outlet formed on an opposite end of said adapter, said water pipe provided to connect said adapter to said fourth water channel of said shower head, said water pipe comprising therein an inner water tube to communicate said water chamber of said adapter to said first water channel of said shower head.

* * * * *